US007814569B2

(12) United States Patent
Di Lorenzo

(10) Patent No.: US 7,814,569 B2
(45) Date of Patent: Oct. 19, 2010

(54) FREE-FLOATING DUAL LAYER SWIMSUIT

(76) Inventor: Joseph Di Lorenzo, 44 Hilltop Dr., Laurel Hollow, NY (US) 11791

( * ) Notice: Subject to any disclaimer, the term of this patent is extended or adjusted under 35 U.S.C. 154(b) by 0 days.

(21) Appl. No.: 11/825,047

(22) Filed: Jul. 3, 2007

(65) Prior Publication Data

US 2008/0256676 A1 Oct. 23, 2008

Related U.S. Application Data

(63) Continuation-in-part of application No. 11/787,636, filed on Apr. 17, 2007, now abandoned.

(51) Int. Cl.
*A41C 3/00* (2006.01)

(52) U.S. Cl. ..... 2/67; 450/31

(58) Field of Classification Search ..... 450/11, 450/30, 15, 31, 33, 74–76; 2/67, 243.1; 66/178 R
See application file for complete search history.

(56) References Cited

U.S. PATENT DOCUMENTS

RE23,255 E 8/1950 Roodner
2,532,375 A 12/1950 Sider
3,311,112 A * 3/1967 Murray ..... 450/1
3,392,730 A * 7/1968 Relli ..... 450/30
3,771,172 A 11/1973 Barg
4,571,742 A 2/1986 Wior
4,956,878 A * 9/1990 Boynton ..... 2/67
5,978,963 A 11/1999 Moskowitz et al.
5,996,120 A 12/1999 Balit
6,766,533 B1 7/2004 Meier et al.

* cited by examiner

*Primary Examiner*—Gloria Hale
(74) *Attorney, Agent, or Firm*—Stetina Brunda Garred & Brucker

(57) ABSTRACT

A swimsuit comprising an inner compression layer attached to an outer layer in a free floating manner is provided. The inner compression layer shapes, contours and slims the wearer's body, whereas the outer layer provides an aesthetically pleasing design. The inner and outer layers are positioned substantially independent from each other on the wearer's body for their respective purposes. It is further contemplated that the outer layer provides an additional shaping, contouring and slimming function in addition to the inner compression layer.

15 Claims, 4 Drawing Sheets

FREE-FLOATING DUAL LAYER SWIMSUIT

CROSS-REFERENCE TO RELATED APPLICATIONS

This is a continuation in part application of U.S. patent application Ser. No. 11/787,636, filed Apr. 17, 2007 now abandoned, the entire content of which is expressly incorporated herein by reference.

STATEMENT RE: FEDERALLY SPONSORED RESEARCH/DEVELOPMENT

Not Applicable

BACKGROUND

The present invention relates to a multi-layered swimsuit for contouring a wearer's body and providing an aesthetically pleasing exterior layer.

Multi-layered swimsuits are old in the art. In particular, the multi-layered swimsuit may have an inner garment and an outer garment. The outer garment provides a visually pleasing appearance, whereas the inner garment may aid in hiding various private portions of the wearer's body and may also be used to shape the wearer's body.

Unfortunately, the prior art swimsuits having multiple layers are manufactured in a way that optimal placement of the inner garment on the wearer's body may shift placement of the outer garment on the wearer's body so as to be sub-optimal, and vice versa. As such, the wearer must choose either to optimally place the inner garment on the wearer's body or optimally place the outer garment on the wearer's body. Either the exterior layer is not optimally placed or the inner layer is not optimally placed.

Accordingly, there is a need in the art for an improved multi layered swimsuit.

BRIEF SUMMARY

The swimsuit described herein addresses the problems identified above, identified below and those that are known in the art.

The swimsuit may comprise an inner compression layer which is attached to an outer layer in a free floating manner. By way of example and not limitation, an upper periphery of the inner compression layer may be permanently or temporarily attached (e.g., stitched, button, snaps, etc.) to an upper periphery of the outer layer. Alternatively, a portion of the upper periphery of the inner compression layer may be permanently or temporarily attached to a portion of the upper periphery of the outer layer. In either case, the inner compression layer may be optimally placed on the wearer's body substantially independent from the placement of the outer layer on the wearer's body, and vice versa. As such, the inner compression layer may be optimally placed on the wearer's body to contour the wearer's body as well as the outer layer may be optimally placed on the wearer's body for a visually appealing effect and hiding seams of the inner layer, if any.

In an aspect of the swimsuit, the outer layer may be strapped over the shoulders of the wearer to hold the outer layer up on the wearer's body. As discussed herein, the outer layer and the inner layer are attached to each other at their respective upper peripheries or portions thereof. The attachment between the outer and inner layers causes the straps of the outer layer to also hold the inner layer up on the wearer's body. Fortunately, the inner and outer layers are disposed under the crotch area of the wearer such that the inner and outer layers do not creep upward. Hence, the straps attached to the outer layer prevent the outer layer from falling down on the wearer's body. Also, the attachment between the outer and inner layers prevents the inner layer from falling down on the wearer's body. Conversely, the inner and outer layers are separately disposed under the crotch area so as to prevent the inner and outer layers from creeping upward on the wearer's body. In this manner, the inner layer and outer layer are securely held on the wearer's body.

In an aspect of the swimsuit, the inner layer and the upper layer are attached to each other at their respective upper peripheries. Also, the outer layer may completely cover the inner layer such that the inner layer is not externally visible when the swimsuit is worn. One of the benefits of attaching the outer and inner layers at their respective upper peripheries is that shifting of the inner and outer layers with respect to each other does not externally expose the inner layer.

The swimsuit may be a one piece swimsuit which extends from the crotch area to the shoulders of the wearer's body. The inner and outer layers may have substantially identical configurations. Alternatively, the swimsuit may be a two piece swimsuit.

Optionally, the straps of the swimsuit may incorporate an adjustable strap system.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
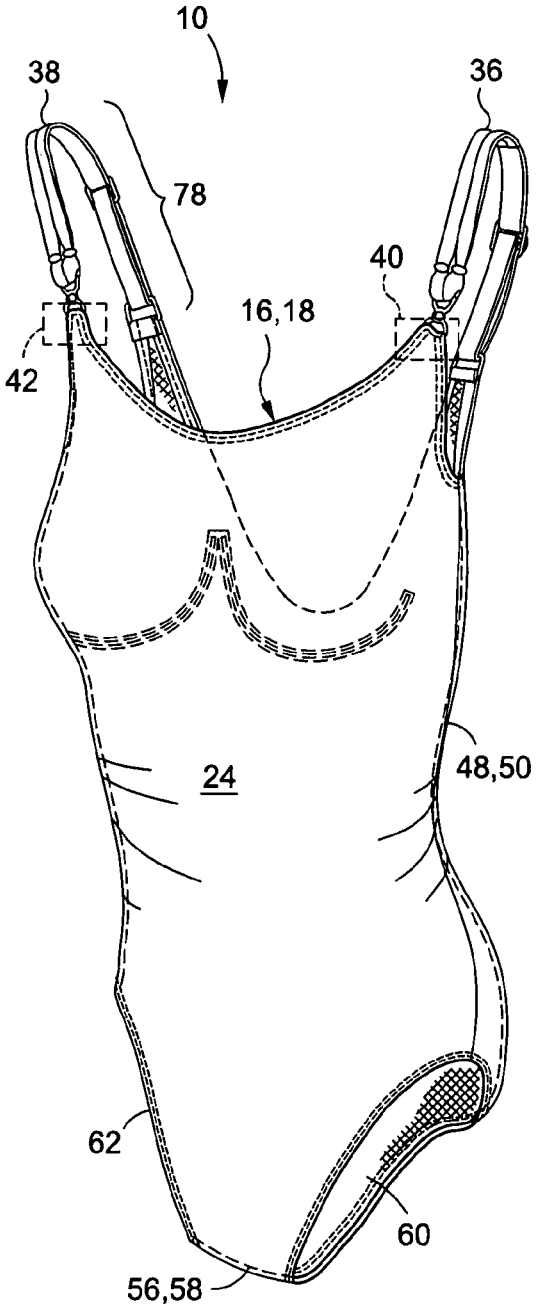
FIG. 1 is a front perspective view of a swimsuit.

Referring now to the drawings, a swimsuit 10 is shown. The swimsuit 10 comprises an inner compression layer 12 and an outer layer 14 attached to each other in a free floating manner. The inner compression layer 12 shapes, contours and slims one or more areas of a wearer's body including but not limited to buttocks, stomachs, breasts, and hips. It is contemplated that the inner compression layer 12 may shape other areas of the wearer's body such as the thighs, arms, etc. The outer layer 14 may cover the entire inner compression layer 12 (see FIG. 1) such that the inner compression layer 12 is not externally visible and may additionally provide an aesthetically pleasing visible appearance.

Figure 2:
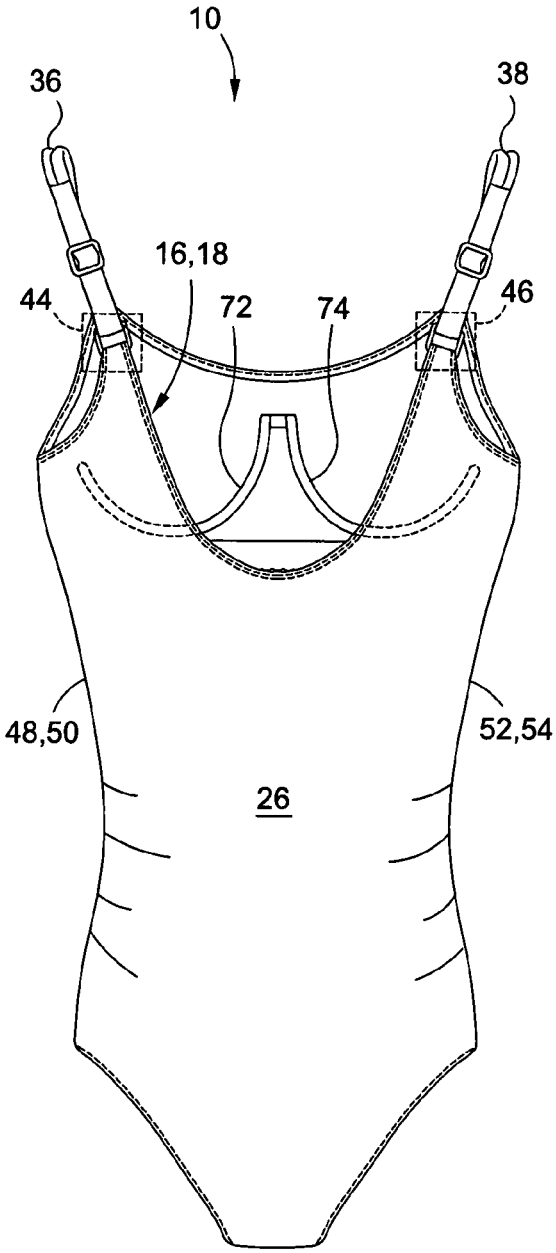
FIG. 2 is a rear view of the swimsuit shown in FIG. 1.

Referring now to FIGS. 1-4, the inner compression layer 12 may be attached to the outer layer 14 in a free floating manner. In particular, the inner compression layer 12 may define an upper periphery 16, as shown in FIGS. 1 and 2. Also, the outer layer 14 may also define an upper periphery 18, as shown in FIGS. 1 and 2. The inner compression layer 12 and the outer layer 14 may be attached to each other at the upper peripheries 16, 18 of the inner compression layer 12 and the outer layer 14. By attaching the inner compression layer 12 and the outer layer 14 at the upper peripheries 16, 18 (see FIGS. 1 and 2) of the inner compression layer 12 and the outer layer 14, the inner compression layer 12 may be positioned on the wearer's body to optimally shape, contour or slim the wearer's body. Additionally, the outer layer 14 may be optimally positioned on the wearer's body to provide an optimal visible and aesthetically pleasing appearance. The outer layer 14 does not substantially shift the position of the inner layer 12, and vice versa such that the inner compression layer 12 may be optimally placed on the wearer's body for contouring and the outer layer 14 may be optimally placed on the wearer's body for aesthetic purposes and to hide the seam lines of the inner layer 12. In this regard, the inner compression layer 12 may be characterized as free floating with respect to the outer layer 14.

Figure 4:
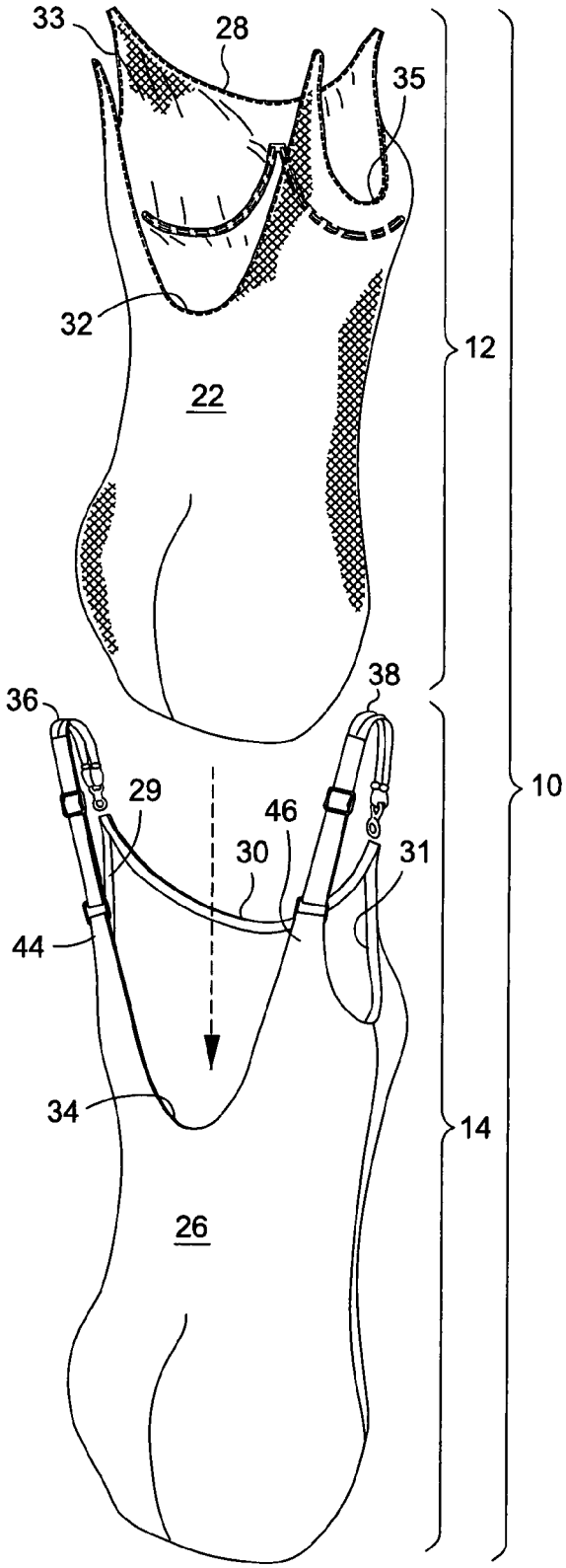
FIG. 4 is a rear exploded perspective view of the swimsuit shown in FIG. 1 illustrating the inner layer for contouring a wearer's body and an outer layer for providing an aesthetically pleasing appearance.

Referring now to FIG. 4, the upper periphery 18 of the outer layer 14 defined by upper edges 30, 34 and underarm edges 29, 31 may be attached to the upper periphery 16 of the inner compression layer 12 defined by the upper edges 28, 32 and underarm edges 33, 35. By way of example and not limitation, the upper edges 30, 34 and underarm edges 29, 31 may be attached to respective upper edges 28, 32 and underarm edges 33, 35. Alternatively, a portion of one or more of the upper edges 30, 34 and/or underarm edges 29, 31 may be attached to a respective portion of one or more of the upper edges 28, 32 and/or underarm edges 33, 35.

More particularly, the inner compression layer 12 may comprise a forward panel 20 (see FIG. 3) as well as rearward panel 22 (see FIG. 4). Also, the outer layer 14 may comprise a front panel 24 (see FIG. 1) and a back panel 26 (see FIG. 4). The upper edge 28 (see FIGS. 3 and 4) of the forward panel 20, the upper edge 32 (see FIG. 4) of the rearward panel 22, the left underarm edge 33, and/or the right underarm edge 35 of the inner compression layer 12 may be attached to the upper edge 30 (see FIG. 4) of the front panel 24, the upper edge 34 (see FIG. 4) of the back panel 26, the left underarm edge 29, and/or the right underarm edge 31 of the outer layer 14 such that the wearer may step into the swimsuit 10 without getting tangled in the inner and outer layers 12, 14. It is also contemplated that the upper peripheries 16, 18 of the inner and outer layers 12, 14 may be characterized as being attached to each other in a free floating manner when one or more of the corresponding edges are at least partially or entirely attached to each other.

The swimsuit 10 may have left and right straps 36, 38 attached to the front and back panels 24, 26 of the outer layer 14 to hold the swimsuit 10 up on the wearer's body. In particular, the front panel 24 of the outer layer 14 may define left and right terminating portions 40, 42 (see FIG. 1). Similarly, the back panel 26 may also define left and right terminating portions 44, 46 (see FIGS. 2 and 4). The left strap 36 may be attached to the left terminating portion 40 of the front panel 24 and the left terminating portion 44 of the back panel 26. Also, the right strap 38 may be attached to the right terminating portion 42 of the front panel 24 and the right terminating portion 46 of the back panel 26. The left and right straps 36, 38 may be fabricated from an elastic material to accommodate various body lengths of wearers. When the swimsuit 10 is worn, the straps 36, 38 are stretched over the shoulders of the wearer. The straps 36, 38 being fabricated from an elastic material pulls the outer layer 14 upward. Since the outer layer 14 is also attached to the inner layer 12, the inner layer 12 is also urged upward. However, as discussed herein, the inner and outer layers 12, 14 are separately disposed under the crotch area of the wearer to prevent the inner and outer layers 12, 14 from rising upward on the wearer's body. In this manner, the inner and outer layers 12, 13 are held snugly against the wearer's body.

Figure 3:
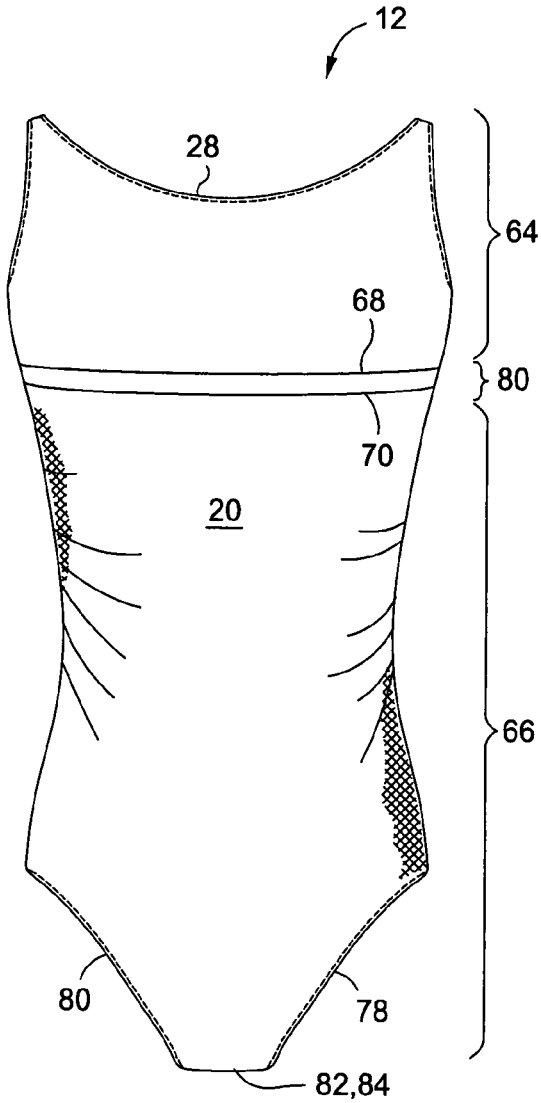
FIG. 3 is a front view of an inner layer of the swimsuit.

More particularly, the outer layer 14 has left and right elastic straps 36, 38 that are strapped over the shoulders of the wearer. These straps 36, 38 help to hold the swimsuit 10 up on the wearer's body such that the swimsuit 10 does not slip down. However, the inner compression layer 12 may not have straps that are disposed over the wearer's shoulders. Rather, the inner compression layer 12 may be formed without straps. The inner compression layer 12 may be attached solely to the upper periphery of the outer layer 14. In this regard, the outer layer 14 pulls the upper periphery of the outer layer upward, and thus the upper periphery of the inner compression layer 12 being attached to the upper of the outer layer may also be pulled upward. To prevent the inner layer 12 from rising upward, the inner compression layer 12 may be sewn together at the crotch area forming left and right leg openings 78, 80, as shown in FIG. 3. More particularly, the forward and rearward panels 20, 22 may be attached to each other at the lower edges 82, 84 (see FIG. 3) thereof similar to the outer layer 14. The attachment of the lower edges 82, 84 of the inner layer's forward and rearward panels 20, 22 holds the inner layer 12 down. The straps 36, 38 of the outer layer 14 pull the inner layer 12 up through the attachment between the inner and outer layers 12, 14 at the upper peripheries 16, 18 thereof. Also, the disposition of the inner layer 12 under the crotch area holds the inner layer 12 downward. These opposing forces maintain the inner compression layer tight against the wearer's body.

The left and right straps 36, 38 may additionally incorporate an adjustable strap system 78 which is more fully described below in relation to FIG. 5. The adjustable strap system 78 permits the wearer to adjust the length of the straps 36, 38 to match the size of the wearer's body. In the event that the adjustable strap system 78 is incorporated into the left and right straps 36, 38, the left and right straps may be fabricated from a non-elastic material or an elastic material.

The outer layer 14 may have various structures and/or designs to provide an aesthetically pleasing appearance. For example, the outer layer 14 may be fabricated from a black colored material. Additionally, the left edge 48 of the front panel 24 may be attached to the left edge of the back panel 26 to form a pleated configuration, as shown in FIGS. 1 and 2. Similarly, the right edge 52 of the front panel 24 may be attached to the right edge 54 of the back panel 26 to form a pleated configuration, as shown in FIG. 2. As shown in FIG. 1, a lower edge 56 of the front panel 24 may be attached to a lower edge 58 of the back panel 26 adjacent the crotch area of the wearer (see FIG. 1) such that the front and back panels 24, 26 may define left and right leg openings 60, 62. The attachment of the lower edges 56, 58 prevent the outer layer 14 from rising upward on the wearer's body.

The left and right leg openings 60, 62 may be formed with a trim. In particular, the fabric itself may be folded inward and sewn to hem the left and right leg openings 60, 62. Similarly, the upper peripheries 16, 18 (see FIGS. 1 and 2) may be formed with a trim by folding the fabric inward and stitching or sewing the folded fabric together. Additionally, when the upper peripheries 16, 18 of the inner and outer layers 12, 14 are formed with a trim, the inner compression layer 12 may be attached to the outer layer 14.

The inner compression layer 12 may be manufactured to shape, contour and slim the wearer's body. In particular, as shown in FIG. 3, the forward panel 20 of the inner compression layer 12 may comprise a breast panel 64 and a stomach panel 66. The breast panel 64 may be sized and configured to substantially cover the wearer's breast. The stomach panel 66 may be sized and configured to substantially cover the wearer's stomach as well as at least a portion of the wearer's crotch area. A lower edge 68 of the breast panel 64 may be attached to an upper edge 70 of the stomach panel 66. The lower edge 68 and the upper edge 70 may be attached to a midriff band 80. The midriff band 80 may be elastic to compress the wearer's body below the wearer's breast. Left and right guide wires 72, 74 (see FIG. 2), each having a U-shaped configuration may be attached to a left portion and a right portion of the breast panel 64, as shown in FIG. 2 to shape the breast of the wearer. It is contemplated that various elastic strips may be attached to the forward and rearward panels 20, 22 of the inner compression layer 12 to achieve various shaping, contouring and slimming objectives. It is also contemplated that the inner compression layer 12 may provide general and/or specific compression to the wearer's body to smoothen any folded fat of the wearer. The inner compression panel 12 may be fabricated to be tight on the wearer's body to compress, shape and form the wearer's body into a desired shapely form.

In an aspect of the swimsuit 10 shown in FIGS. 1-4, the inner compression layer 12 may be cut and sewn to provide better fit and/or compression. Alternatively, the inner compression layer 12 may be seamless.

Figure 5:
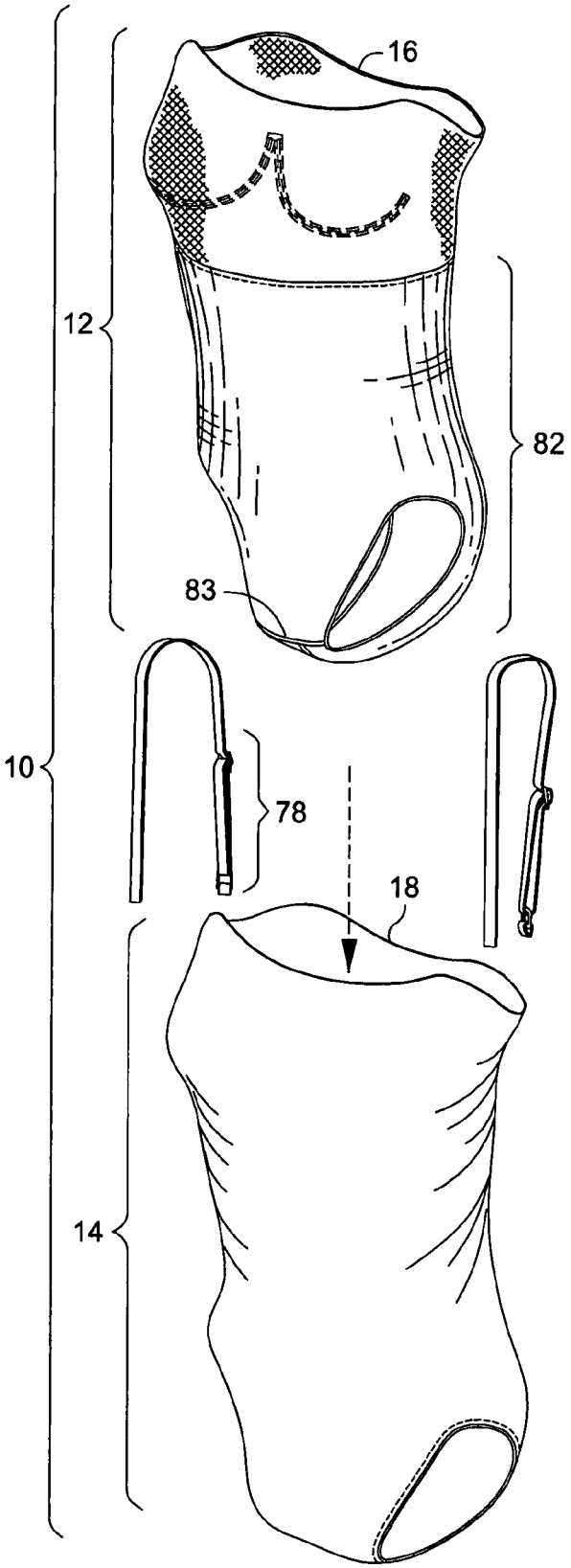
FIG. 5 is a front exploded perspective view of a second embodiment of the swimsuit.

Referring now to FIG. 5, a second embodiment of the swimsuit 10 is shown. The swimsuit 10 may incorporate one or more of the various features discussed above in relation to the swimsuit shown in FIGS. 1-4. Moreover, the lower portion 82 of the inner compression layer 12 may be seamless. In particular, the lower portion 82 may be fabricated similar to a tube. Unlike the inner compression layer 12 shown in FIGS. 3 and 4, the inner compression layer 12 shown in FIG. 6 does not have separate forward and rearward panels 20, 22 which are sewn together at their lateral peripheries. Rather, the lower portion 82 of the inner compression layer 12 may be fabricated as a tube so as to be seamless about its outer periphery. Alternatively, the lower portion 82 of the inner compression layer may be cut and sewn to provide better fit and/or compression.

Figure 6:
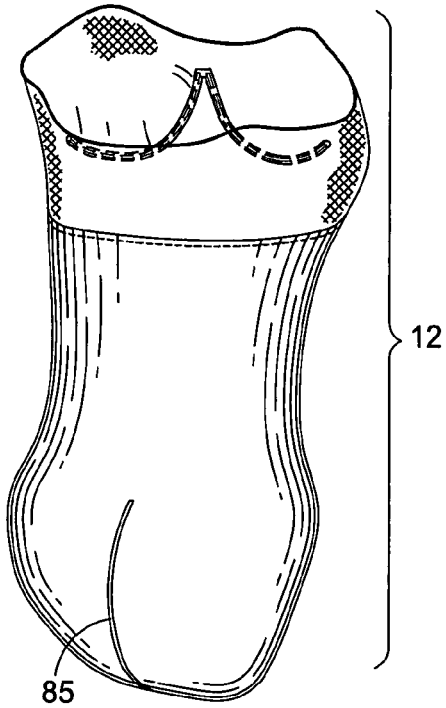
FIG. 6 is a rear perspective view of the inner compression layer shown in FIG. 5.

The lower portion 82 of the inner compression layer 12, as shown in FIG. 6 may have a seam 83 (see FIG. 5) at the crotch area and a seam 85 (see FIG. 6) which may join seam 83 at the rear medial section thereof. Nonetheless, the lower portion 82 of the inner compression layer 12 may still be characterized as being seamless as long as a portion of an outer periphery of the lower portion 82 is seamless.

Figure 7:
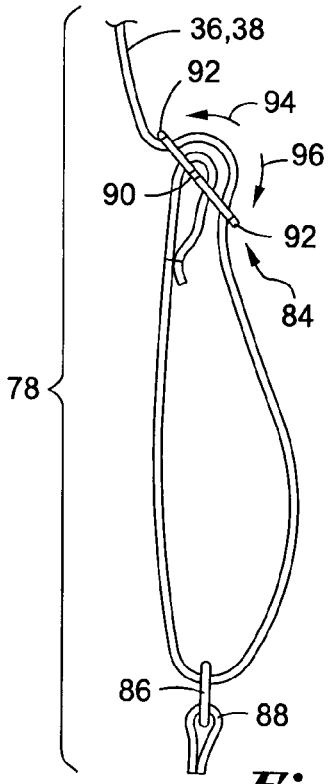
FIG. 7 is an enlarged side view of an adjustable strap system for adjusting a strap of the outer layer shown in FIG. 5.

In an aspect of the swimsuit shown in FIG. 5, the adjustable strap system 78 (see FIG. 7) may be incorporated into the left and right straps 36, 38. The adjustable strap system 78 discussed herein may also be incorporated into the swimsuit shown in FIG. 1 as well as the swimsuit 10 shown in FIG. 8. In particular, the adjustable strap system 78 may comprise a sliding adjuster 84, a ring element 86 and a fabric connector 88. The adjustable strap system 10 is operative to lengthen or shorten the length of the straps 36, 38 to accommodate various sized swimmers. The adjustable strap system 78 operates in the following manner. In particular, the strap 36, 38 is looped through the sliding adjuster 84 over a middle bar 90 and under opposed bars 92. Opposed bars 92 hold the strap 36, 38 down. The strap is then looped through the ring element 86 and attached to the middle bar 90 of the sliding adjuster 84. The ring element 86 is attached to the fabric connector 88 which is also attached to a rear upper periphery of the outer layer 14. To lengthen the strap 36, 38, the strap 36, 38 is fed through the sliding adjuster 84 in the direction of arrow 94 shown in FIG. 7. Once the appropriate length of the strap 36, 38 is reached, the straps 36, 38 are placed in tension when the swimsuit 10 is worn by the swimmer. When the straps 36, 38 are placed in tension, the opposed bars 92 of the sliding adjuster 84 presses down on the straps 36, 38 while the middle bar 90 simultaneously pushes upward on the straps 36, 38. Friction is created on the straps 36, 38 over the middle bar 90. This friction locks the position of the sliding adjuster 84 such that when the swimsuit 10 is worn by the swimmer, the straps 36, 38 are not loosened and enlarged. Conversely, to shorten the strap 36, 38 the strap 36, 38 is fed through the sliding adjuster 84 in the direction of arrow 96.

The inner compression layer 12 may be attached to the outer layer 14 in the manner discussed in relation to the swimsuit 10 discussed in relation to FIGS. 1-4. In particular, at least a portion of the upper periphery 16 of the inner compression layer 12 may be attached to the upper periphery 18 of the outer layer 14. This permits the inner compression layer to be optimally placed on the wearer's body substantially independent from the placement of the outer layer 14 on the wearer's body.

Figure 8:
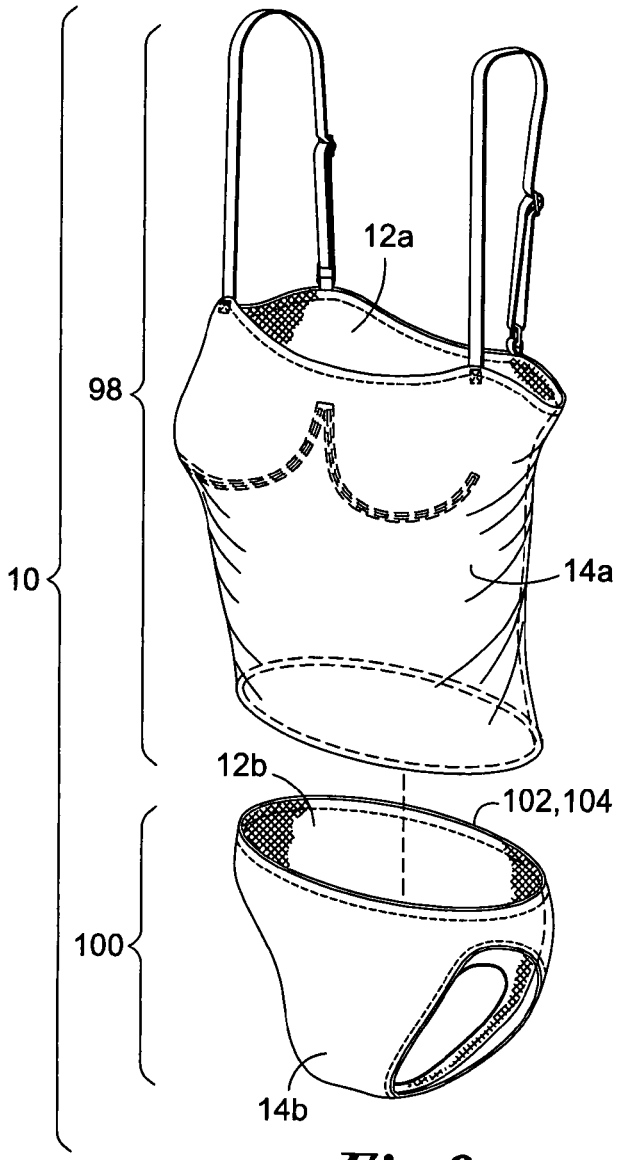
FIG. 8 illustrates a third embodiment of the swimsuit wherein a top portion comprises an inner compression layer free floating with respect to an outer layer and a bottom portion comprises an inner compression layer free floating with respect to an outer layer.
Figure 10:
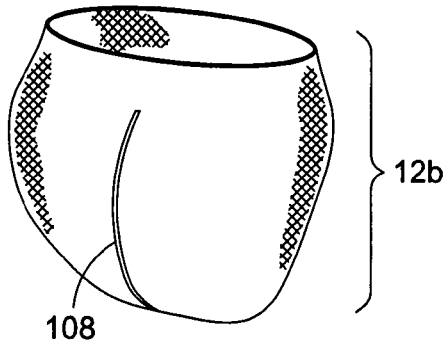
FIG. 10 is a rear perspective view of the inner compression layer shown in FIG. 9.
Figure 9:
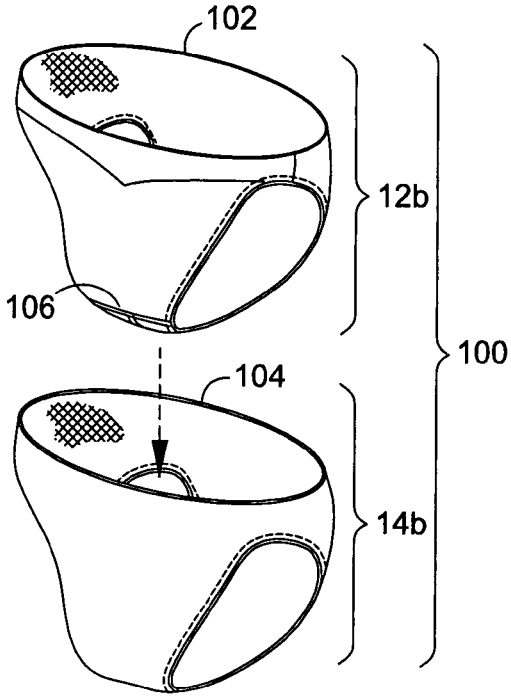
FIG. 9 is an exploded front perspective view of the bottom portion shown in FIG. 8.

Referring now to FIGS. 8-10, a third embodiment of the swimsuit 10 is shown. The swimsuit 10 comprises an upper portion 98 separate from a lower portion 100. The upper portion 98 may have an identical configuration as compared to the swimsuits 10 described and shown in FIGS. 1 and 5. By way of example and not limitation, in an aspect, the inner compression layer may be configured to tightly fit against the wearer's body to shape and contour the wearer's body. Also, at least a portion of an upper periphery of the inner layer 12*a* may be attached to at least a portion of an upper periphery of the outer layer. In this manner, the upper portion 98 may have an inner compression layer 12*a* and an outer layer 14*a* which are free floating with respect to each other. Moreover, the lower portion of the inner compression layer 12*a* may be seamless. Alternatively, the lower portion of the inner compression layer 12*a* may be cut and sewn to provide better fit and/or compression.

The lower portion 100 may also comprise an inner compression layer 12*b* and an outer layer 14*b*. The inner and outer layers 12, 14 may be attached to each other at upper peripheries 102, 104 of the inner and outer layers 12, 14. Similar to the swimsuit 10 shown in FIG. 5, the inner compression layer 12*b* of the swimsuit 10 shown in FIG. 8 of the lower portion 100 may be seamless. The inner compression layer 12*b* may be characterized as seamless as long as a portion of an outer periphery of the inner compression layer 12*b* of the lower portion 100 is seamless. For example, the inner compression layer 12*b* of the lower portion 100 may have a seam 106 about the crotch area of the inner compression layer 12*b*. Also, the inner compression layer 12*b* of the lower portion 100 may have a seam 108 which may join the seam 106 at the rear of the inner compression layer 12*b*. Alternatively, the inner compression layer 12*b* may be cut and sewn to provide a better fit and/or compression.

Optionally, in relation to all embodiments of the swimsuit 10, it is contemplated that the outer layer 14 may also provide additional shaping, contouring and slimming forces in addition to the inner compression layer 12. In this regard, various elastic strips (not shown) may be attached to the outer layer 14 to achieve the shaping, contouring and slimming objectives of the swimsuit 10. Moreover, the elasticity of the elastic strips attached to the outer layer 14 may be different compared to the elasticity of the elastic strips attached to the inner compression layer 12. Moreover, instead of elastic strips, the inner compression layer 12 and the outer layer 14 may optionally be fabricated from various materials to achieve the various shaping, contouring and slimming objectives of the swimsuit 10. By way of example and not limitation, the stomach panel 66 of the inner layer 12 may be fabricated from a highly elastic material to tightly compress the stomach area of the wearer. In contrast, the stomach portion of the front panel 24 of the outer layer 14 may be fabricated from a less elastic material to loosely fit over the stomach area of the wearer. Such combination provides a loose fit look of the swimsuit on the wearer. The outer layer 14 as discussed above may comprise a front panel 24 and a back panel 26. It is also contemplated that the front and back panels 24, 26 may be formed of a plurality of different shaped and sized panels such that the outer layer 14 may fit the wearer's body better and be more comfortable to wear. Likewise, the forward and rearward panels 20, 22 of the inner compression layer 12 may be fabricated from a plurality of different sized and shaped panels such that the inner compression layer 12 may fit the wearer's body better and be more comfortable to wear.

In an aspect of the three embodiments of the swimsuit 10, the inner compression layer 12 may be permanently attached to the outer layer 14 at the upper peripheries of the inner and outer layers 12, 14. As discussed above, the inner and outer layers 12, 14 may be permanently attached via stitching, sewing. However, any method known in the art for permanently attaching the inner and outer layers together are contemplated. It is also contemplated that the inner compression layer 12 be removeably attachable to the outer layer 14 via any method known in the art (e.g., Velcro, buttons, snaps, etc.).

In an aspect of the three embodiments of the swimsuit 10, the inner compression layer 12 may have the same general configuration as the outer layer 14. By way of example and not limitation, the outer layer 14 may be a one piece swimsuit 10 that covers the genitalia, breasts and at least a portion of the front of the wearer's body therebetween, as shown in FIGS. 1 and 2. Correspondingly, the inner layer 12 may have a one piece configuration that covers the genitalia, breasts and at least a portion of the front of the wearer's body therebetween. In another example, the outer layer 14 may be a one piece swimsuit 10 that covers the genitalia, breast and at least a portion of the front of the wearer's body therebetween and that additionally has tubular members (not shown) attached to the outer layer 14 that tightly or loosely fit over the thighs of the wearer. In this instance, the inner layer 12 may correspondingly have a one piece configuration that covers the genitalia, breasts and at least a portion of the front of the wearer's body therebetween, and also tubular members attached to the inner layer 12 that tightly or loosely fit over the thighs of the wearer. The inner layer 12 may be characterized as having the same configuration as the outer layer 14. However, it is further contemplated that the inner layer 12 may still be characterized as having the same configuration as the outer layer 14 even if the inner layer 12 is not formed with the tubular members disposable over the wearer's thighs. In the swimsuit shown in the drawings, although the inner layer 12 discussed above does not have straps that are disposed over the shoulders of the wearer and the outer layer 14 does have straps disposed over the shoulders of the wearer, the inner layer 12 may still be characterized as having the same configuration as the outer layer 14. In a further alternative, the two piece swimsuit 10 shown in FIG. 8 may be characterized as having inner and outer layers 12*a, b* and 14*a, b* which have the same configuration.

In an aspect of the three embodiments of the swimsuit 10, the terms upper peripheries 16, 18 of the inner and outer layers 12, 14 include the upper peripheral ends of the inner and outer layers 12, 14 as well as upper peripheral portions of the inner and outer layers 12, 14. As such, an upper portion of the upper periphery 18 of the outer layer 14 attached to an upper portion of the upper periphery 16 of the inner layer 12 may still be characterized as the upper periphery 18 of the outer layer as being attached to the upper periphery 16 of the inner layer 12.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A swim suit wearable by a wearer, the swim suit comprising:

a one piece inner compression layer covering genitalia, breasts, and a portion of a wearer's body therebetween, the inner compression layer being sized and configured to snugly fit against the wearer's body for shaping the wearer's body, the inner compression layer defining an upper periphery, a portion of the inner compression layer being a seamless tube; and a one piece outer compression layer covering the inner compression layer and having a matching configuration with respect to the inner compression layer, the outer compression layer defining an upper periphery, the outer compression layer being attached to the inner compression layer only at the entire upper peripheries of the inner and outer compression layers such that the wearer may step into the swimsuit without inadvertently stepping between the inner and outer compression layers;

wherein the inner compression layer floats freely with respect to the outer layer for positioning the inner layer on the wearer's body for shaping and the outer layer is positioned on the wearer's body for aesthetic appeal.

2. The swim suit of claim 1 wherein the outer layer compresses the wearer's body for further shaping the wearer's body.

3. The swim suit of claim 1 wherein the inner layer floats freely with respect to the outer layer such that the inner compression layer is positioned on the wearer's body substantially independent from the position of the outer layer.

4. The swim suit of claim 1 wherein a majority of the upper peripheries of the inner compression layer and the outer layer are attached to each other.

5. The swim suit of claim 1 wherein less than half of the upper peripheries of the inner compression layer and the outer layer are attached to each other.

6. The swim suit of claim 1 wherein the inner compression layer is attached to an inside surface of the outer layer.

7. The swim suit of claim 1 further comprising a strap attached to the upper periphery of the outer layer to hold the swim suit up when worn by the wearer, the strap further comprising an adjustable strap system for adjusting a length of the strap such that the swim suit may be customized to fit the wearer.

8. The swim suit of claim 1 wherein the front and hack panels each define left and right strap attachment portions, and a left elastic strap is attached to the left strap attachment portions of the front and back panels, and a right elastic strap is attached to the right strap attachment portions of the front and back panels.

9. The swim suit of claim 1 wherein the inner and outer layers are disposed under a crotch area of the wearer to prevent the inner and outer layers from rising upward.

10. The swim suit of claim 1 wherein the outer layer covers the entire inner compression layer.

11. The swim suit of claim 1 wherein the inner compression layer is cut and sewn.

12. A swim suit wearable by a wearer, the swim suit comprising:

an upper portion for covering a torso and breasts of a wearer, the upper portion comprising:

an inner compression layer covering breasts of a wearer, the inner compression layer being sized and configured to snugly fit against the wearer's body for shaping the wearer's body, the inner compression layer defining an upper periphery, a portion of the inner compression layer being a seamless tube: and an outer compression layer covering the inner compression layer and having a matching configuration with respect to the inner compression layer, the outer layer defining an upper periphery, the outer compression layer being attached to the inner compression layer only at the entire upper peripheries of the inner and outer compression layers such that the wearer may step into the swimsuit without inadvertently stepping between the inner and outer compression layers;

wherein the inner compression layer floats freely with respect to the outer layer for positioning the inner layer on the wearer's body for shaping and positioning the outer layer on the wearer's body for aesthetic appeal.

13. A swim suit wearable by a wearer, the swim suit comprising:

a lower portion for covering a pelvis area of the wearer, the lower portion comprising:

an inner compression layer covering genitalia of wearer, the inner compression layer being sized and configured to snugly fit against the wearer's body for shaping the wearer's body, the inner compression layer defining an upper periphery, a portion of the inner compression layer being a seamless tube; and an outer compression layer covering the inner compression layer and having a matching configuration with respect to the inner compression layer, the outer layer defining an upper periphery, the outer compression layer being attached to the inner compression layer only at the entire upper peripheries of the inner and outer compression layers such that the wearer may step into the swimsuit without inadvertently stepping between the inner and outer compression layers;

wherein the inner compression layer floats freely with respect to the outer layer for positioning the inner layer on the wearer's body for shaping and positioning the outer layer on the wearer's body for aesthetic appeal.

14. The swim suit of claim 1 wherein the outer layer comprises:

a front panel defining an upper edge;

a back panel defining an upper edge;

an elastic strap attached to the upper edges of the front and back panels to hold the swim suit up when worn by the wearer and for fitting various sized wearers.

15. The swimsuit of claim 4 wherein the entire upper periphery of the inner compression layer is attached to the upper periphery of the outer layer.

* * * * *